US007399402B2

(12) United States Patent
Olivier et al.

(10) Patent No.: US 7,399,402 B2
(45) Date of Patent: Jul. 15, 2008

(54) METHOD FOR HYDROTREATMENT OF A MIXTURE OF HYDROCARBON COMPOUNDS, RICH IN OLEFINS AND AROMATIC COMPOUNDS

(75) Inventors: Catherine Olivier, Ittre (BE); Walter Vermeiren, Houthalen (BE); Jean-Pierre Dath, Beloeil (BE)

(73) Assignee: Total Petrochemicals Research Feluy, Feluy (BE)

( * ) Notice: Subject to any disclaimer, the term of this patent is extended or adjusted under 35 U.S.C. 154(b) by 852 days.

(21) Appl. No.: 10/416,058

(22) PCT Filed: Nov. 6, 2001

(86) PCT No.: PCT/EP01/12989

§ 371 (c)(1),
(2), (4) Date: Nov. 10, 2003

(87) PCT Pub. No.: WO02/38701

PCT Pub. Date: May 16, 2002

(65) Prior Publication Data

US 2004/0045873 A1 Mar. 11, 2004

(30) Foreign Application Priority Data

Nov. 7, 2000 (EP) ..... 00203887

(51) Int. Cl.
*C10G 45/04* (2006.01)

(52) U.S. Cl. ..... 208/213; 208/216 R; 208/217; 208/145

(58) Field of Classification Search ..... 208/213
See application file for complete search history.

(56) References Cited

U.S. PATENT DOCUMENTS 3,284,344 A * 11/1966 Demeester et al. ..... 208/262.1
3,859,204 A 1/1975 Brunn et al.
4,112,007 A 9/1978 Sanfilippo et al.

FOREIGN PATENT DOCUMENTS

GB 1555270 12/1977

* cited by examiner

*Primary Examiner*—Tam M. Nguyen
(74) *Attorney, Agent, or Firm*—Shirley A. Kopecky; William D. Jackson

(57) ABSTRACT

Process for the hydrotreatment of a mixture of C4 to C8 hydrocarbon-based compounds, rich in olefins and monoaromatic compounds, by hydrogenation in the presence of a solid catalyst, characterized in that an ammonia precursor is introduced into the charge of hydrocarbon-based compounds and in that the catalyst comprises at least one transition metal supported on at least one refractory oxide.

20 Claims, No Drawings

METHOD FOR HYDROTREATMENT OF A MIXTURE OF HYDROCARBON COMPOUNDS, RICH IN OLEFINS AND AROMATIC COMPOUNDS

The present invention relates to a process for the hydrotreatment of a mixture of hydrocarbon-based compounds comprising from four to eight carbon atoms, which is rich in olefins and monoaromatic compounds. The invention relates more particularly to the hydrotreatment of fractions resulting from the distillation of crude petroleum, from vapor-cracking, from catalytic reforming, from catalytic cracking, from coking or from any process producing such fractions, and to the fractions derived from the treatment of coal, for instance coaltar oils.

It is well-known practice to hydrotreat all the fractions derived from the distillation of petroleum crudes in the presence of hydrogen and a catalyst consisting of transition metals supported on refractory oxides. It is much less obvious to hydrotreat, under these conditions, hydrocarbon-based mixtures containing large amounts of olefins of C4 to C8 compounds and containing large proportions of monoaromatic compounds such as benzene, toluene and xylene. During the hydrotreatment, there is total or partial hydrogenation of the olefins and diolefins and oligomerization of the monoaromatic compounds, forming compounds of C12 and higher. However, when the hydrogenated and desulfurized mass subsequently undergoes the standard treatment of extractive distillation by solvent in order to extract the monoaromatic compounds contained, certain oligomers present, formed during the hydrotreatment, cannot be removed from the solvent since their boiling point is too close to that of the solvent. Consequently, these oligomers accumulate in the extraction solvent and it becomes necessary periodically to stop the distillation in order to change the solvent so as to purify it.

The cost of this operation is not negligible in that it comprises the cost of purifying the solvent, the possible cost of purchase of fresh clean solvent, the running cost associated with the interruption of the plant to change the solvent, and the cost corresponding to the loss of monoaromatic compounds that cannot be sold. These problems of selective hydrogenation of olefinic compounds in the presence of large amounts of aromatic compounds were solved in French patent 2 376 100. Said patent proposes to pretreat the supported catalyst consisting of at least one noble metal on alumina, for instance ruthenium, rhodium, platinum and/or palladium, with a stream of ammonia gas and optionally by continuing the treatment by injecting this ammonia gas into the reactor during the hydrogenation itself. Such a treatment has the major drawback of requiring the pretreatment of the catalyst in situ under a controlled atmosphere of ammonia alone or mixed with another inert gas such as nitrogen, and thus under pressure. Such a situation finds little favor in industry, since it imposes safety constraints. In addition, via this route, it is difficult to control the amount of ammonia placed in contact with the catalyst: an excessive amount of ammonia leads to deactivation of the catalyst, including that with regard to the intended reactions.

Patent U.S. Pat. No. 3,859,204 teaches that the asphaltenic oils derived from treatments of bituminous sands, tar or coal may be desulfurized in the presence of hydrogen and a catalyst comprising nickel, cobalt and/or molybdenum, taken in a combination of two or three on an alumina support. As for the above patent, the catalyst is pretreated with ammonia in situ in the reactor and it is suggested to introduce aniline, pyrrole, pyridine or amine compounds into the incoming flow of hydrogen. Besides the problems associated with the conditioning of the catalyst are the problems associated with the introduction of liquid compounds into the gas flow at high pressure.

The refiner is confronted with a twofold constraint, associated firstly with the injection of the liquid into a gas flow at high pressure (technological constraints in terms of rating of the charging pump and of design of the safety systems especially to avoid the backflow of hydrogen in the event of stoppage of the pump), and secondly with its dispersion by means of a suitable diffuser, taking into account the pressures used in the process.

The present patent application is thus directed toward a process that requires neither pretreatment of the catalyst nor the introduction of gaseous or liquid nitrogen compounds into the hydrogenation gas. It is directed toward a simple process that can be implemented easily irrespective of the hydrotreatment plant, that does not require overly expensive investments in terms of equipment, with a catalyst that is relatively cheap compared with catalysts containing noble metals such as platinum and palladium, and that can be adapted to the charges, the composition of which may vary in olefin concentration and in the concentration of monoaromatic compounds, and that allows good desulfurization of the charge.

The term "olefins" means herein the monoolefinic and diolefinic compounds generally present in the charges sent for hydrotreatment.

One subject of the present invention is thus a process for the hydrotreatment of a mixture of C4 to C8 hydrocarbon-based compounds, rich in olefins and monoaromatic compounds, by hydrogenation in the presence of a solid catalyst, characterized in that an ammonia precursor is introduced into the charge of hydrocarbon-based compounds and in that the catalyst comprises at least one transition metal supported on at least one refractory oxide.

The term "transition metal" means any transition metal with the exception of the "noble" metals, especially platinum and palladium.

One of the advantages of the process is associated with the introduction of an ammonia precursor into the charge, which allows the release, during the reaction, of ammonia gas, which is present during the selective hydrogenation reaction of the olefins and which may be recovered and recycled with the unused hydrogen. Among the other advantages associated with the invention, this process makes it possible to precisely control the amount of ammonia released during the hydrotreatment reaction. In addition, it allows the unwanted oligomerization reactions to be limited while at the same time maintaining excellent activity of the catalyst for the desired reactions of selective hydrogenation of the olefins and of desulfurization of the charge.

Without being bound by a theory, the Applicant has found that, firstly, the oligomerization of the aromatic compounds results from the presence of acidic sites on the catalyst, these sites being of variable acid strength. Secondly, the efficacy of the hydrotreatment reaction depends on the electron-deficiency of the catalytic support, which is itself correlated with its acidity.

It is thus a matter of selectively blocking the sites responsible for the oligomerization reactions of the aromatic compounds, these sites having an acidic strength which is such that they remain saturated with ammonia under the temperature and pressure conditions selected for the hydrotreatment reaction in the context of the present invention. In spite of everything, under these conditions, enough electron-deficient sites remain to maintain good activity of the hydrotreatment process.

More specifically, in the context of the present invention, up to 1000 ppm by nitrogen molar equivalent weight of ammonia precursor are injected into the charge.

For optimum efficacy of the process according to the invention, from 5 to 1000 ppm by nitrogen molar equivalent weight of nitrogen precursor, and preferably from 10 to 200 ppm, will be injected.

To implement the process, the ammonia precursors are chosen from nitrogen compounds capable of releasing ammonia gas under the hydrotreatment conditions. These ammonia precursors must decompose before arriving on the catalyst, so as to release the ammonia as close as possible to the catalyst, and, to do this, must have a decomposition temperature that is less than the reaction temperature in the reactor.

In one preferred embodiment of the invention, the decomposition temperature of the ammonia precursors is less than 300° C. and preferably less than 180° C.

In one preferred embodiment of the invention, the ammonia precursor is chosen from linear and branched amines, polyamines, imines, and urea and its derivatives. The amines and polyamines are chosen from the group consisting of mono-, di- and trialkylamines containing from 1 to 10 carbon atoms per alkyl group, the alkyl groups being linear or cyclic, and polyalkylamines containing from 1 to 5 nitrogen atoms, each alkyl group containing from 1 to 6 carbon atoms in linear or branched form. The preferred amines and polyamines are chosen from methylamine, ethylamine, propylamine, butylamine, pentylamine, hexylamine, heptylamine, cyclohexylamine, cycloheptylamine, dimethylamine, diethylamine, dipropylamine, dibutylamine, trimethylamine, triethylamine, tripropylamine, tributylamine, methylenediamine, ethylenediamine, propylenediamine, butylenediamine, dimethylenetriamine, diethylenetriamine, dipropylenetriamine, triethylenetetramine, tripropylenetetramine, tetraethylenepentamine and tetrapropylenepentamine, cyclohexylamine, triethylamine and ethylenediamine being preferred.

The catalyst required for the process according to the invention consists of at least one metal chosen from the group consisting of nickel, cobalt, molybdenum, vanadium and tungsten; nickel alone and nickel/molybdenum, cobalt/molybdenum and nickel/tungsten combinations are preferred. This or these metal(s) is (are) supported on at least one refractory oxide chosen from alumina, silica, silicoaluminas, aluminophosphates, zirconia, magnesia and titanium oxides, in rutile and anatase form, these oxides being present in amorphous or crystalline form.

For optimum efficacy of the hydrotreatment reaction, the process is performed at a temperature of between 50 and 400° C., under a pressure of between $10^6$ Pa and $10^7$ Pa and preferably between $3\times10^6$ Pa and $6\times10^6$ Pa, and an hourly space velocity ranging from 0.5 to 10 $h^{-1}$.

In one preferred embodiment of the hydrotreatment process, the excess ammonia gas formed may be recycled into the hydrogen-rich recycling gas. This has the advantage of limiting the amount of ammonia precursor injected into the charge.

This hydrotreatment process is particularly suitable for the hydrotreatment of C6 petroleum refinery fractions, especially the $C_6$ fractions derived from reforming and the catalytic oils derived from catalytic cracking.

The examples hereinbelow are given to illustrate the invention, without wishing to limit the scope thereof.

EXAMPLE I

The present example describes the conditions under which the invention is implemented, showing the benefit provided by introducing an ammonia precursor into an industrial charge to be hydrotreated, for different ammonia precursors and for different concentrations thereof.

The charge to be hydrotreated is a mixture containing 21% by weight of a C6 reforming fraction and 79% by weight of a C6 pyrolysis oil fraction. It contains:

57% by weight of benzene

12% by weight of olefins 12 ppm by total weight of sulfur.

The benzene content was measured by applying the method UOP 744-86 referred to in the "Laboratory test methods for petroleum and its products", published by UOP Process Division, (UOP Inc. 20 UOP Plaza-Algonquin Mt Prospect Roads-Des Plaines-Ill. 60016).

The olefin content is determined by measuring the bromine number, by applying ASTM standard D1159, and the sulfur content by the method ASTM D2622.

Three ammonia precursors were used on a hydrotreatment pilot plant for 100 ml of catalyst, at a temperature of 200° C., a pressure of $26.5\times10^5$ Pa, working with an $H_2$/hydrocarbons ratio of 230 Nl/l, the hourly space velocity of the charge being 1.6 $h^{-1}$.

These precursors are triethyleneamine or TEA, cyclohexylamine or CHA and ethylenediamine or EDA.

The efficacy for each of the tests performed is evaluated relative to the decrease in the number of C12 compounds formed, the decrease in the bromine number and the decrease in the sulfur content. The results are given in Table I below.

TABLE I

| Nature of the precursor | N equivalent (ppm weight) | $C_{12}$ content (ppm weight) | Bromine index* (mg $Br_2$/100 g) | Sulfur (ppm weight) | Nitrogen** (ppm weight) |
|---|---|---|---|---|---|
| None | 0 | 215 | 8 | <0.5 | <0.5 |
| TEA | 25 | 11 | 76 | 0.5 | <0.5 |
| | 100 | 12 | 657 | <0.5 | <0.5 |
| | 200 | 13 | 758 | 1 | <0.5 |
| CHA | 10 | 5 | 14 | <0.5 | <0.5 |
| EDA | 25 | 1 | 63 | <0.5 | <0.5 |
| | 30 | 1 | 99 | 0.5 | <0.5 |

*bromine index = $10^{-3}$ × bromine number

**determined by ASTM standard D5762

The results obtained indicate that the injection of EDA, TEA or CHA as ammonia precursors into the charge introduced into a hydrotreatment plant allows an appreciable reduction in the formation of $C_{12}$ compounds. It may readily be observed that it is possible to optimize the amount of amine to be added to the charge in order simultaneously to satisfy the specifications in terms of bromine index, associated with the olefin concentration and with the sulfur concentration. It will be noted that the amines are totally decomposed during the reaction since the nitrogen content is less than 0.5 ppm by weight.

EXAMPLE II

The present example is directed toward highlighting the efficacy of the process irrespective of the relative concentrations of olefins and of monoaromatic compounds in the charge.

In this respect, two industrial charges, the composition of which is given below, were tested according to the procedure described in Example I, but at different reaction temperatures. Their composition is given in Table II below.

TABLE II

| Charge | Nature | T ° C. | Bromine number (g $Br_2$/100 g) | Benzene (wt %) | Sulfur (ppm weight) |
|---|---|---|---|---|---|
| 1 | Pyrolysis oil C6 fraction | 240 | 30 | 85 | 60 |
| 2 | 21% (1) + 79% (2) | 200 | 7 | 57 | 12 |

In the example, cyclohexylamine, or CHA, is used as ammonia precursor.

The results obtained with and without ammonia precursor for each of these charges are given in Table III below.

TABLE III

| Charge | CHA (N molar equiv. in ppm weight) | Production of $C_{12}$ (ppm weight) | Bromine index (mg $Br_2$/100 g) | Sulfur (ppm weight) | Nitrogen (ppm weight) |
|---|---|---|---|---|---|
| 1 | 0 | 489 | 78 | <0.5 | <0.5 |
| | 40 | 8 | 83 | <0.5 | <0.5 |
| 2 | 0 | 276 | 11.5 | <0.5 | <0.5 |
| | 10 | 4.5 | 14 | <0.5 | <0.5 |

From this table, it is seen that the addition of the nitrogen precursor, irrespective of the nature of the charge, makes it possible to reduce the formation of C12 compounds by oligomerization, while at the same time maintaining the required characteristics of the expected final product, including the nitrogen thereof, the precursor being totally decomposed.

We claim:

1. A process for the hydrotreatment of an olefin-rich feedstock comprising:

(a) providing a reactor containing a solid hydrogenation catalyst comprising at least one transition metal supported on at least one refractory oxide;

(b) supplying hydrogen and an olefin-rich feedstock comprising a mixture of $C_4$-$C_8$ hydrocarbon-based compounds rich in olefins and at least one monoaromatic compound into said reactor and into contact with said hydrogenation catalyst while maintaining said reactor under pressure and temperature conditions effective for the hydrogenation of said olefins; and (c) incorporating into said olefin-rich feedstock an ammonia precursor which decomposes to release ammonia in said reactor which comes into contact with said catalyst.

2. The process of claim 1 wherein said ammonia precursor is incorporated into said olefin-rich feedstock in an amount of up to 1,000 ppm nitrogen molar equivalent weight.

3. The process of claim 2 wherein said ammonia precursor is incorporated into said feedstock in an amount within the range of 5-1,000 ppm nitrogen molar equivalent weight.

4. The process of claim 2 wherein said nitrogen precursor is incorporated into said feedstock in an amount within the range of 10-200 ppm nitrogen molar equivalent.

5. The process of claim 1 wherein said ammonia precursor comprises a nitrogen-containing compound capable of releasing ammonia gas under the temperature and pressure conditions in said reactor.

6. The process of claim 5 wherein said ammonia precursor has a decomposition temperature of less than 300° C.

7. The method of claim 6 wherein said ammonia precursor has a decomposition temperature of less than 180° C.

8. The process of claim 1 wherein said ammonia precursor is selected from the group consisting of linear and branched amines, polyamines, imines, and urea and its derivatives.

9. The process of claim 8 wherein said ammonia precursor is an amine or polyamine chosen from the group consisting of mono-, di- and trialkylamines containing from 1 to 10 carbon atoms per alkyl group, the alkyl groups being linear or cyclic, and polyalkylamines containing from 1 to 5 nitrogen atoms, each alkyl group containing from 1 to 6 carbon atoms in linear or branched form.

10. The process of claim 9 wherein said ammonia precursor is an alkyl amine or a polyalkylamine selected from the group consisting of from methylamine, ethylamine, propylamine, butylamine, pentylamine, hexylmine, heptylamine, cyclohexylamine, cycloheptylamine, dimethylamine, diethylamine, dipropylamine, dibutylamine, triemethylamine, triethylamine, tripropylamine, tributylamine, methylenediamine, ethylenediamine, propylenediamine, butylenediamine, dimethylenetriamine, diethylenetriamine, dipropylenetriamine, triethylenetetramine, tripropylenetetamine, tetracthylenepentamine, and tetrapropylenepentamine.

11. The process in claim 10 wherein said ammonia precursor is selected from the group consisting of cyclohexylamine, triethylamine and ethylenediamine.

12. The process of claim 1 wherein said reactor is operated at a temperature within the range of 50-400° C., a pressure within the range of $10^6$ Pa-$10^7$ Pa, and a space velocity within the range of 0.5-10 $h^{-1}$.

13. The process of claim 12 wherein said ammonia precursor has a decomposition temperature which is less than the temperature at which the reactor is operated.

14. The process of claim 12 wherein said reactor is operated at a pressure within the range of $3\times10^6$ Pa-$6\times10^6$ Pa.

15. The process of claim 1 wherein the support of said hydrogenation catalyst is selected from the group consisting of alumina, silica, zirconia, silicoaluminas, alumino-phosphates, zirconia, magnesia and titanium oxides, in rutile and anatase form, said oxides being present in amorphous or crystalline form.

16. The process of claim 15 wherein said transition metal is selected from the group consisting of nickel, cobalt, moldenum, vanadium, tungsten, and mixtures thereof.

17. The combination of claim 16 wherein said transition metal is nickel.

18. The process of claim 16 wherein said transition metal is selected from the group consisting of a nickel/molybdenum composite, a nickel/tungsten composite, and a cobalt/molybdenum composite.

19. The process of claim 1 wherein said reactor is operated under conditions to produce an excess of ammonia gas which is withdrawn from said reactor, and further comprising recycling said ammonia gas into the hydrogen supplied to said reactor.

20. The process of claim 1 wherein said feedstock comprises the product of a $C_6$ fraction produced from a catalytic reforming operation or a vapor reforming operation.

* * * * *